US005944506A

United States Patent [19]

Kamal et al.

[11] Patent Number: 5,944,506

[45] Date of Patent: Aug. 31, 1999

[54] BURNER ASSEMBLY WITH TIGHT SHUT-OFF OPPOSED LOUVER AIR DAMPER

[75] Inventors: Azfar Kamal, Arkansas City; Danny L. Christenson, Mulvane, both of Kans.

[73] Assignee: Gordon-Piatt Energy Group, Inc., Winfield, Kans.

[21] Appl. No.: 08/842,726

[22] Filed: Apr. 16, 1997

Related U.S. Application Data

[60] Provisional application No. 60/015,842, Apr. 18, 1996.

[51] Int. Cl.[6] ..... F23D 11/00

[52] U.S. Cl. ..... 431/159; 431/12; 431/181; 454/336; 137/601

[58] Field of Search ..... 431/159, 12, 181, 431/187; 137/601; 454/326, 336

[56] References Cited

U.S. PATENT DOCUMENTS

| | | | |
|---|---|---|---|
| 3,783,768 | 1/1974 | Caming et al. | 98/110 |
| 3,869,243 | 3/1975 | Creuz . | |
| 4,097,227 | 6/1978 | Brock | 432/187 |
| 4,256,143 | 3/1981 | Magill et al. | 137/601 |
| 4,275,762 | 6/1981 | Field | 137/601 |
| 4,294,283 | 10/1981 | Scharres | 137/601 |
| 4,363,440 | 12/1982 | Broach | 236/20 R |
| 5,454,757 | 10/1995 | Wirfel | 454/336 |
| 5,708,538 | 1/1998 | Fujino et al. | 360/96.5 |

OTHER PUBLICATIONS

Lucoma AG, Precision control flaps for air conditioning plants, Reglair 5001–G–M52–SM220 (no date on publication).

*Primary Examiner*—Ira S. Lazarus
*Assistant Examiner*—Josiah Cocks
*Attorney, Agent, or Firm*—Crowe & Dunlevy

[57] ABSTRACT

An opposed louver air damper apparatus for controlling the flow rate of combustion air to a burner fire box, comprising a plurality of adjacent, rotatable louvers having rubber tips and side gaskets providing sealing between the louvers and a frame, and geared responsive shafts supporting the louvers for controllably rotating the louvers to determinative positions to modulate the volume of air passing through the louver apparatus, wherein the gears in meshing engagement precisely maintains the relative position of the louvers, and the gaskets operate to minimize undesirable leakage through the air damper. The gears form teeth in arcuate portions of the full circumference to limit the rotational movement to only that within the toothed portion of the gear.

22 Claims, 5 Drawing Sheets

BURNER ASSEMBLY WITH TIGHT SHUT-OFF OPPOSED LOUVER AIR DAMPER

CROSS REFERENCE TO RELATED APPLICATION

This application claims the benefit of U.S. Provisional Patent Application Ser. No. 060/015,842, fled Apr. 18, 1996.

BACKGROUND OF THE INVENTION

1. Field of the Invention

The present invention relates to forced-air burners, and more particularly, but not by way of limitation, to the use of a modulating air damper to precisely control the combustion air flow rate to the fire box of the burner to produce high turn down ratios.

2. Background

Commercial and industrial burners are essentially of two types: atmospheric burners, in which the air required for combustion is attained without any prime mover (such as a blower or fan), and forced-air burners, which rely on a blower for feeding combustion air. Atmospheric burners are mainly limited to low heating rate domestic equipment, whereas forced-air burners comprise the majority of burners used in commercial and industrial applications.

Air regulation in forced-air burners can be achieved by installing louver boxes on air dampers, either at the blower inlet or outlet. Louver boxes are generally provided with a circular or rectangular configuration. The number and size of louvers in commercial burners can vary from one louver to several louvers, with two or three louvers being most common. In large industrial burners, as many as 10 to 15 louvers are not uncommon.

Louver actuating mechanisms typically provide either a parallel louver construction, wherein all blades open in the same direction, or an opposed louver construction, wherein adjacent louvers open in opposite directions. An opposed blade louver box is comparatively expensive to make but is superior to a same size parallel blade louver box, as an opposed blade louver box provides comparatively superior air flow modulation. Superior air modulation is critical to the obtaining of a high turn down ratio—the ratio of the high and low heating rates between which a burner can be safely modulated without exceeding emission standards. There is a long felt need in the industry for an improved way to precisely modulate combustion air to a burner, especially in regard to better controlling the air flow at low heating rates so as to increase the burner turn down ratio.

One recognized solution is to keep the air damper closed at low heating rates and allow the air that leaks through the damper to support combustion. This approach is taught in U.S. Pat. No. 3,869,243 issued to Creuz. While such an approach certainly allows the operation at lower heating rates, and thereby increasing the turn down ratio, the approach is unsettling to experienced boiler operators who would prefer to be in precise control of air flow modulation. The approach will also be unpredictable, in that manufacturing variances will determine the amount of air leakage that a closed damper will provide, and part to part variation will result in wide variation to low heating burner performance.

One skilled in the art will recognize the benefits of a precisely modulating air damper, having an opposed louver construction, and having louver seals which prevent air flow through the damper at a closed position, thereby enabling the boiler operator to finely trim air flow at low heating rates, resulting in improved burner turn down ratios.

SUMMARY OF THE INVENTION

The present invention comprises a burner having an improved air damper apparatus. The air damper comprises an opposed louver construction, wherein the louvers are sealed to minimize undesired leakage. The air damper further comprises a geared linkage for precise and positive modulation of the louvers. The air damper louvers are characteristically wing-shaped to minimize flow restriction in a fully open position, and to minimize noise and imbalance conditions in modulating positions less than fully open.

The present invention provides superior modulation capability of combustion air flow, especially at low heat conditions where minimal air flow is needed. The air damper is positionable to determinative air flow rates anywhere along the continuum from fully open to sealed shut. The geared interrelationship of adjacent louvers provides superior control of the louver by preventing flutter and backlash, thereby reliably maintaining a desired determinative position. The better control and improved air flow characteristics of the louvers provide modulation over a greater range of burner heat load demands, thereby providing improved turn down ratios by the burner.

An object of the present invention is to provide improved burner turn down ratio performance.

A further object of the present invention, while achieving the above object, is to provide combustion air flow to a burner by a modulating air damper at any desired air flow rate in the continuum between a fully open position to a fully closed and sealed shut position.

Yet another object of the present invention, while achieving the above objects, is to provide an air damper having a superior linkage system between adjacent louvers to positively place and maintain each louver to a determinative position which provides a desired combustion of air flow rate.

Another object of the present invention, while achieving the above objects, is to provide an air damper for the modulation of combustion air flow rate that performs with minimal noise and vibration.

Another object of the present invention, while achieving the above objects, is to provide an air damper that is functionally reliable and readily adaptable to efficient manufacturing processes.

Other objects, advantages and features of the present invention will be apparent from the following description when read in conjunction with the accompanying drawings and appended claims.

DESCRIPTION OF THE DRAWINGS

FIG. 6A shows a plan view of a gear portion of the air damper of FIG. 1; FIG. 6B is a side view of the gear of FIG. 6A; and FIG. 6C shows adjacent gears of the type shown in FIG. 6A at a rotation-limited position.

DESCRIPTION

Figure 1:
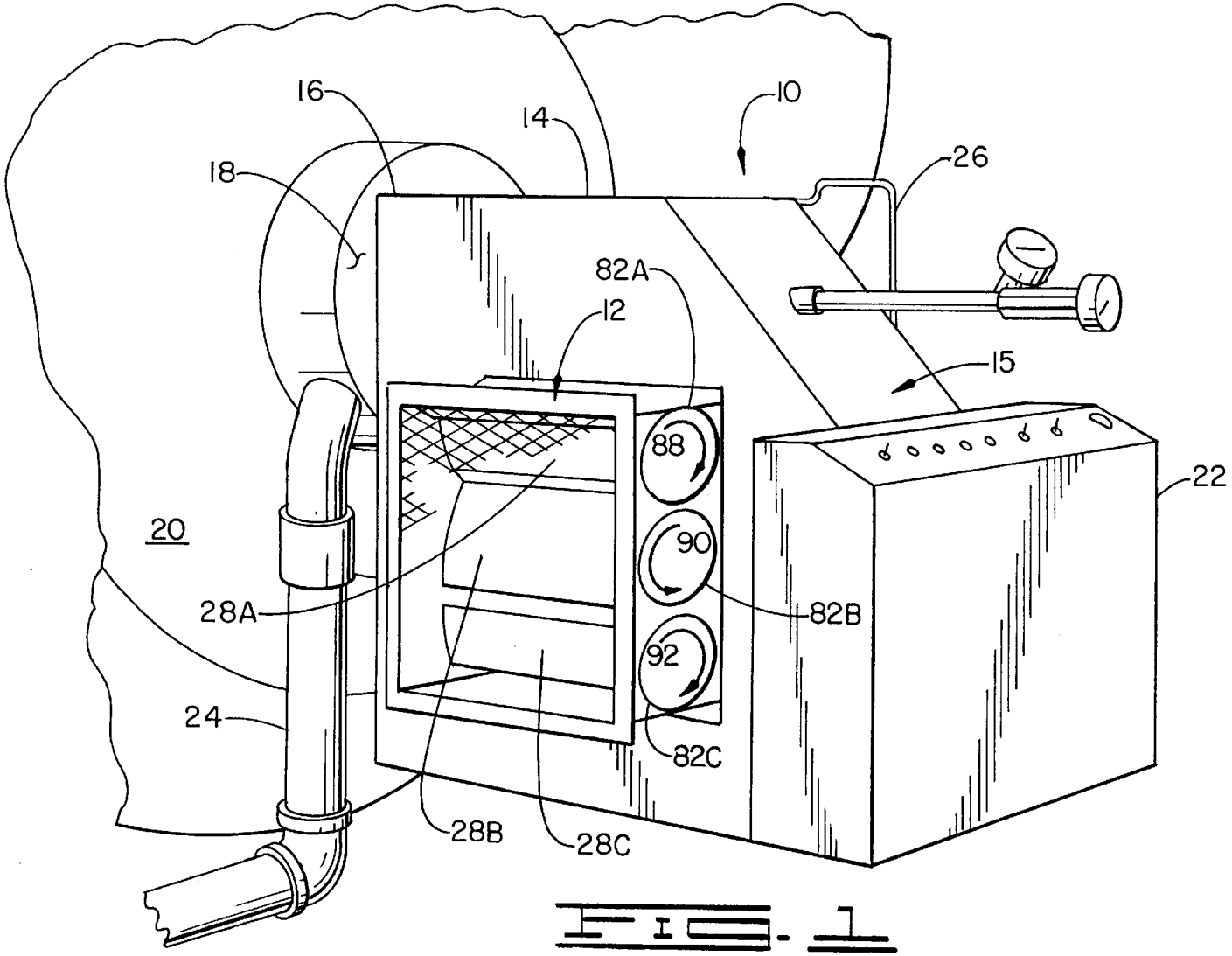
FIG. 1 illustrates a commercial burner employing a modulating air damper constructed in accordance with the present invention.

Referring to the drawings in general and in particular to FIG. 1, shown therein is a burner assembly 10 constructed in accordance with the present invention. It will be understood that numerous details of structure and construction have been omitted where such are deemed unnecessary for the purposes of the present disclosure as such details would be within the skill and knowledge of persons skilled in the art. Further, the same numerals will be used commonly throughout the following description for construction features common to the drawings.

FIG. 1 shows the burner assembly 10 employed in a typical manner firing a commercial boiler 20 for hot water and/or HVAC purposes. The burner assembly 10 operates on a dual fuel basis, gas or oil, and is capable of a higher turn-down ratio performance, in comparison to prior art burner assemblies, as a result of the improvement to the burner assembly 10 which comprises an improved modulating air damper 12.

The air damper 12 is attached to a blower housing 14, which encloses a blower assembly 15 comprising a motor (not shown) and a blower wheel (not shown). The blower assembly 15 provides air to a combustion chamber (not shown) to support combustion of the desired fuel. The throat portion 16 of the blower housing 14 is attached to the burner head 18 which partially encloses a fire box where combustion occurs.

A control panel 22 contains the electrical system controls and wiring, and provides access to the switches and indicators used in operation of the burner assembly 10. The control system 22 controls in a common manner an actuator motor (not shown) to throttle the fuel supply, either in the gas supply line 24 or in the oil supply line 26, and to modulate the air damper 12.

The air damper 12 has an air inlet opening 12A in which are mounted several louvers 28A, 28B and 28C. Modulation of the air damper 12 determines the flow rate of combustion air to the burner assembly 10 by variably restricting the flow area of the inlet opening 12A through which the combustion air passes. The flow area is made variable by rotating the louver about its longitudinal central axis. The flow area is maximized when the louver is rotated to an open position, whereat the louver is substantially coplanar with the air flow. Contrarily, the flow area is minimized, in fact sealed tight, when the blade is rotated to a closed position, whereat the louver is transverse to the air flow. One skilled in the art will recognize the advantages provided by an air damper positionable along the full continuum between sealed closed and fully open to modulate the burner firing rate as system load so demands.

Figure 2:
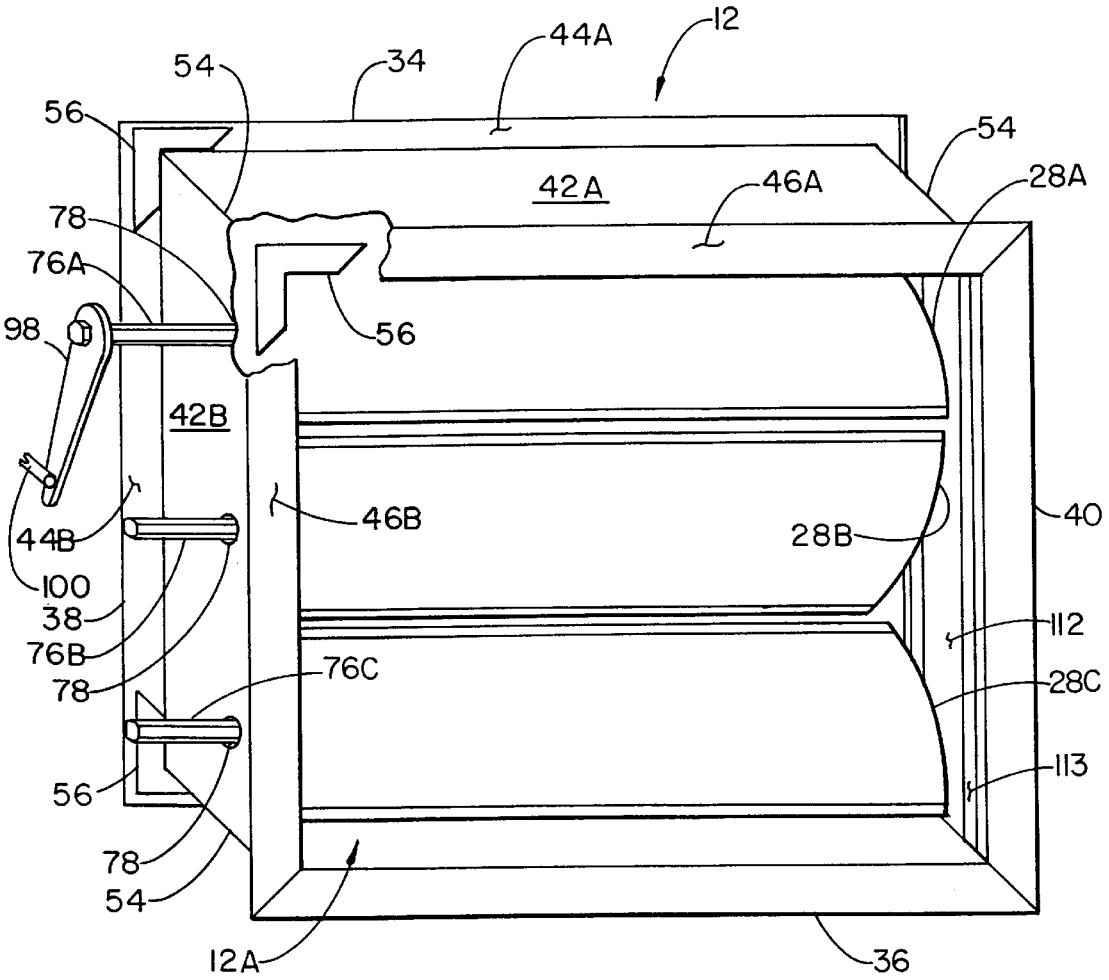
FIG. 2 shows a diagrammatical view of the air damper of FIG. 1.

Turning now to FIG. 2, shown therein is the air damper 12 and the three louvers 28A, 28B, 28C. The number of louvers is determined by the size of the air damper 12 necessary to support the air flow requirements for combustion. Whether the air damper has one louver or a plurality is of no consequence, because the construction of the present invention is simply additive as more than two louvers are required. The present invention is well illustrated by the three-louvered air damper of FIG. 2, as it will be obvious to one skilled in the art that air dampers of like construction but having fewer or more louvers are equivalent embodiments to that taught herein.

The air damper 12 has a frame comprising a top 34, a bottom 36, and sides 38, 40 which are joined to form an air-tight frame. The top 34 forms a substantially flat portion 42A and opposed transverse flanges 44A, 46A. In like manner, the side 38 forms a substantially flat portion 42B and opposed transverse flanges 44B, 46B. The top 34 and side 38 are joined, forming corner 54, by the attachment of a corner bracket 56, to adjacent flanges 44A, 44B and 46A, 46B. The corner bracket is attached by well known methods such as a fasteners, screws or rivets, or by welding. Corners 54 are sealed by well known methods such as caulking or welding. The other three corners 54 formed by adjacent members are joined and sealed in the same manner. Note that the illustration of one corner of the frame is partially cutaway to show the typical attachment of corner bracket 56 to adjacent flanges 46A, 46B.

Figure 3:
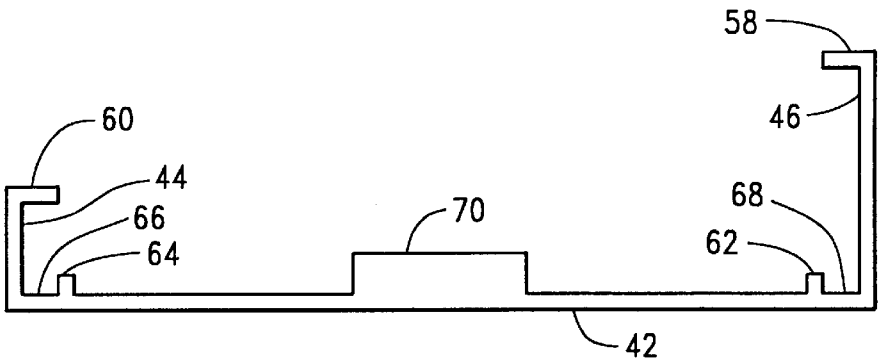
FIG. 3 is a cross-sectional view of the extrusion of the air damper frame of FIG. 1, shown in greater detail in FIG. 2.

The frame members 34, 36, 38, 40 are formed from an extruded material having a cross-section shown in FIG. 3. The air damper 12 frame is well suited to manufacture using an extrusion, as is well known in the art, as all members 34, 36, 38, 40 can be cut to length and mitered from a common extrusion, to form various size frames. Shown in FIG. 3 is the flat portion 42 and the opposed transverse flanges 44, 46. Stiffening flanges 58, 60 and stiffening ribs 62, 64 provide structural rigidity to the frame. Cavities 66, 68 receivingly retain the corner brackets 56 to aid in the joining of adjacent members. A central hub 70 supports a bushing (not shown) for a rotatable shaft, as discussed below. Note the flange 46 is sufficiently long, and may furthermore be provided with appropriate apertures therein, to accommodate fasteners for attachment of the air damper 12 to the blower housing 14. The opposed flange 44 is preferably shorter to reduce the material cost of the frame.

Returning to FIG. 2, shown therein is shaft 76A which is supported by sides 38, 40. The shaft 76A has a first portion receivingly disposed within a bushing 78 that is, in turn, supported by the side 38, and a second portion likewise receivingly disposed with a bushing (not shown) supported by side 40. Recalling FIG. 3, the bushings are transversely disposed within apertures extending through the extrusion at the hub portions 70. The hub portion 70 thereby provides sufficient strength and rigidity to support the shaft 76A in its function as described below.

Figure 4:
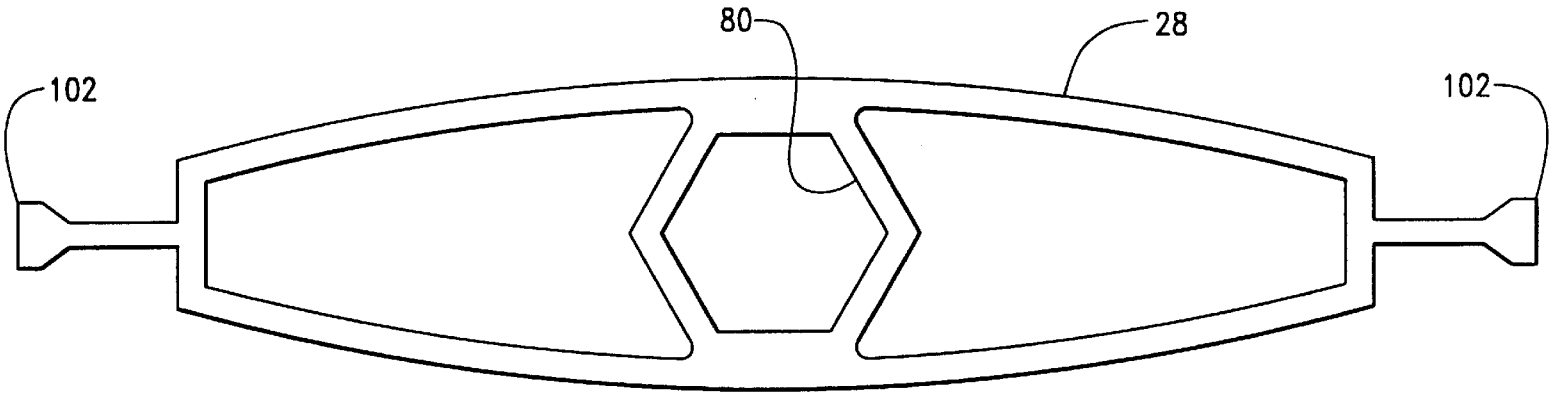
FIG. 4 is a cross-sectional view of a louver portion of the air damper of FIG. 1.

The shaft 76A medially supports the louver 28A between the sides 38, 40. The shaft 76A and louver 28A are matingly engaged so that rotation of the shaft 76A imparts rotation to the louver 28A. The present invention achieves this mating engagement by the use of a shaft 76 comprising hexagonal stock disposed within a hexagonal central portion 80 of the louver 28 as shown in FIG. 4. One skilled in the art will recognize equivalent alternative embodiments for matingly engaging the shaft 76A and louver 28A, such as using a round shaft and a round louver central portion, and the louver 28A further supporting a threaded set screw impingingly engaging the shaft 76A.

As shown in FIG. 1, a gear 82A is supported by the shaft 76A, and the gear 82A is matingly engaged with the shaft 76A so that rotation of the shaft 76A imparts rotation to the gear 82A. The present invention uses a gear 82 as shown in FIG. 6A, forming a hexagonal central bore 80 through which a distal portion of the shaft 76 is disposed. One skilled in the art will recognize equivalent alternative embodiments for matingly engaging the shaft 76 and gear 82, such as a set screw (not shown) supported by a hub 86 (see FIG. 6B) of the gear 82.

Referring now to FIG. 1 and FIG. 2, a middle shaft 76B is rotatably supported by the sides 38, 40, and matingly engages louver 28B and gear 82B. Likewise, a lower shaft 76C is rotatably supported by sides 38, 40, and matingly engages louver 28C and gear 82C. The gears 82A, 82B are in meshing engagement so that a clockwise rotation of gear 82A (as shown by the arrow 88 in FIG. 1) imparts a counter-clockwise rotation to gear 82B (as shown by the arrow 90). Likewise, gears 82B, 82C are in meshing engagement so that the counterclockwise rotation of gear 82B imparts a clockwise rotation to gear 82C (as shown by arrow 92). Note that the rotational interrelationship of the gears 82A, 82B, 82C is bi-directional. That is, a counter-clockwise rotation of gear 82A will impart a clockwise rotation to gear 82B and a counter-clockwise rotation to gear 82C. Also note that the rotational interrelationship of the gears 82A, 82B, 82C is not limited to gear 82A imparting the rotation; rotation of any one of the gears will impart rotation to the other two.

Turning now to FIG. 6A, shown therein is a novel rotation limiting feature of the air damper 12. The gear 82 has a plurality of teeth 94 in opposed arcs above and below a horizontal central axis. FIG. 6C diagrammatically represents the meshed gears 82A, 82B from FIG. 1, shown at the maximum clockwise rotational position of gear 82A. Further rotation is prevented by abutment of opposed non-toothed segments 96A, 96B.

Having discussed the air damper 12 construction, the operation will now be addressed. FIG. 2 shows an arm 98 attached to the shaft 76A, and matingly engaged thereon so as to transfer rotational motion of the arm 98 to the shaft 76A. An actuator motor (not shown) is connected to the link arm 98 in a conventional manner, such as by linkage 100. The actuator is responsive to the burner assembly control system so as, in turn, to rotate the arm 98 and thus modulate the air damper 12 to increase or decrease the flow rate of combustion air. Rotation of the arm 98 imparts rotation to the shaft 76A which, in turn, imparts rotation to the louver 28A. The rotation of shaft 76A imparts rotation to gear 82A, which, in turn, imparts rotation to gear 82B. The rotation of gear 82B imparts, in turn, rotation to the middle shaft 76B which is matingly engaged to louver 28B (in like manner as above) so as to impart rotation to the louver 28B. The rotation of gear 82B furthermore imparts rotation to gear 82C. Gear 82C imparts, in turn, rotation to the lower shaft 76C which is matingly engaged to louver 28C (in like manner as above) so as to impart rotation to the louver 28C. In this manner, the actuator's rotation of the arm 98 effects rotation to the louvers 28A, 28B, 28C.

Turning now to a discussion of the novel approaches to sealing the rotating louvers, FIG. 4 shows the louver 28 has characteristic top portions 102 which receivingly engage an internal passage 104 of a blade tip 106 (see FIG. 5). The tip 106, shown in cross-sectional detail in FIG. 5, is extruded from a flexible material, such as EPDM rubber. The tip has a hollow tip end 108 so as to provide a relatively thin and flexible wall thickness of material at an engaging portion 110. The thin and flexible wall thickness provides superior conformity characteristic to the tip 106, and thus provides superior sealing characteristics.

Two adjacent louvers, such as 28A, 28B that are rotated into substantially vertical position are sealingly engaged in a tip to tip fashion; that is, the lower tip 106 of louver 28A sealingly engages the upper tip 106 of louver 28B. In this orientation, the air damper is closed, sealing off air flow between the louver tips.

Another seal is provided between the ends of the louvers 28 and the sides 38, 40 of the frame. FIG. 2 shows a strip of gasket 112 attached to the side 40, the gasket 112 being compressingly disposed between the end of the louvers 28 and the side 40. A gasket 112 is likewise disposed between the louvers 28 and the side 38, although not shown in FIG. 2. The gasket of the present invention is a foam material, such as polyurethane, with an adhesive backed facing 113, such as MYLAR, a film of polyethylene terephthalate. The facing 113 is somewhat wider than the foam, and is adhered to the foam and to the sides 38,40 on both sides of the foam. In this manner, the facing 113 provides a reliable seal by protecting the foam from contaminants of the harsh operating environment, and by protecting the foam from the wiping action of the rotating louver 28.

The louvers 28 and sides 38, 40 are thereby sealed, allowing no airflow therebetween when the louvers 28 are in a closed position (vertically aligned). The ends of the louvers 28 continue to be sealed when the louvers are positioned at minimal air flow positions, to force the air flow across the louver tips 106 to enhance air flow when modulating capability during low fire operation of the burner 10.

Figure 5A:
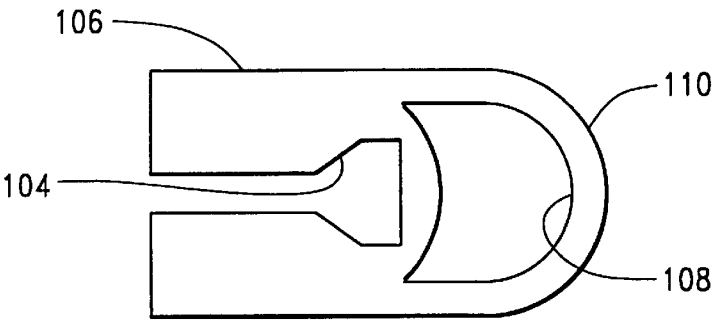
FIG. 5A is a cross-sectional view of a louver tip.
Figure 5B:
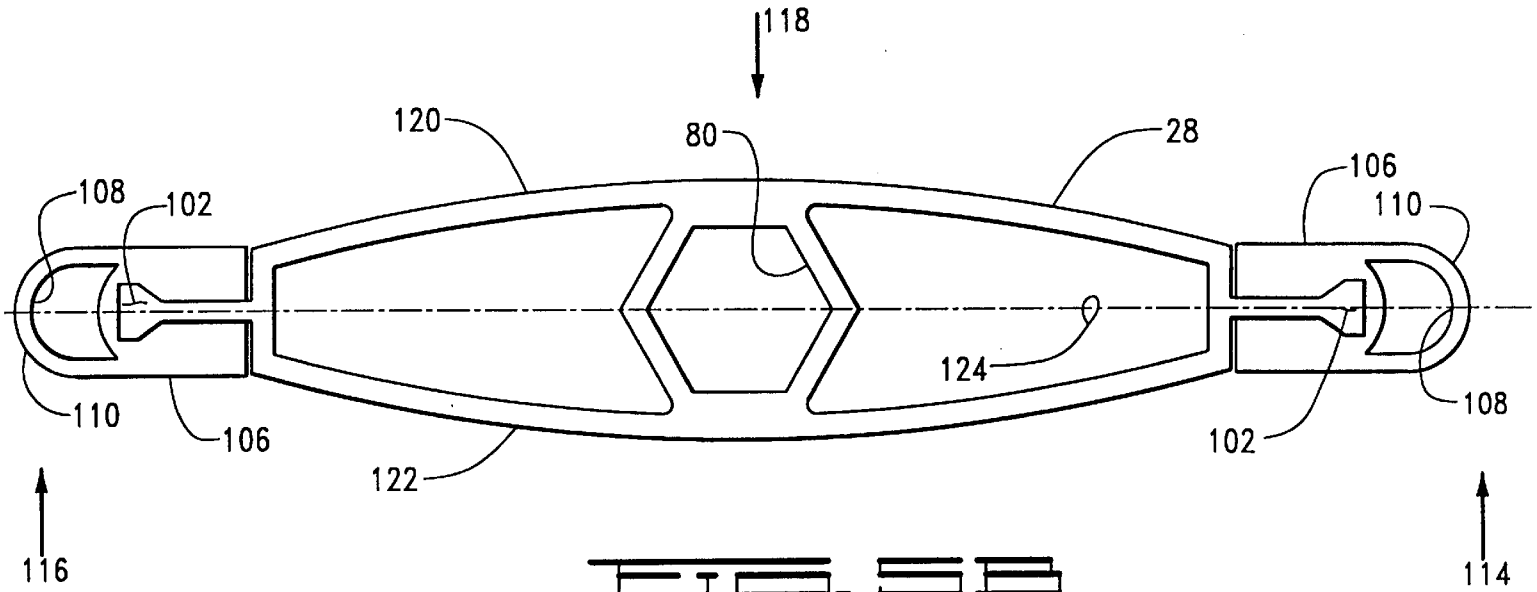
FIG. 5B is a cross-sectional view of the louver portion of FIG. 4 supporting a pair of tips of FIG. 5A.
Figure 5A:
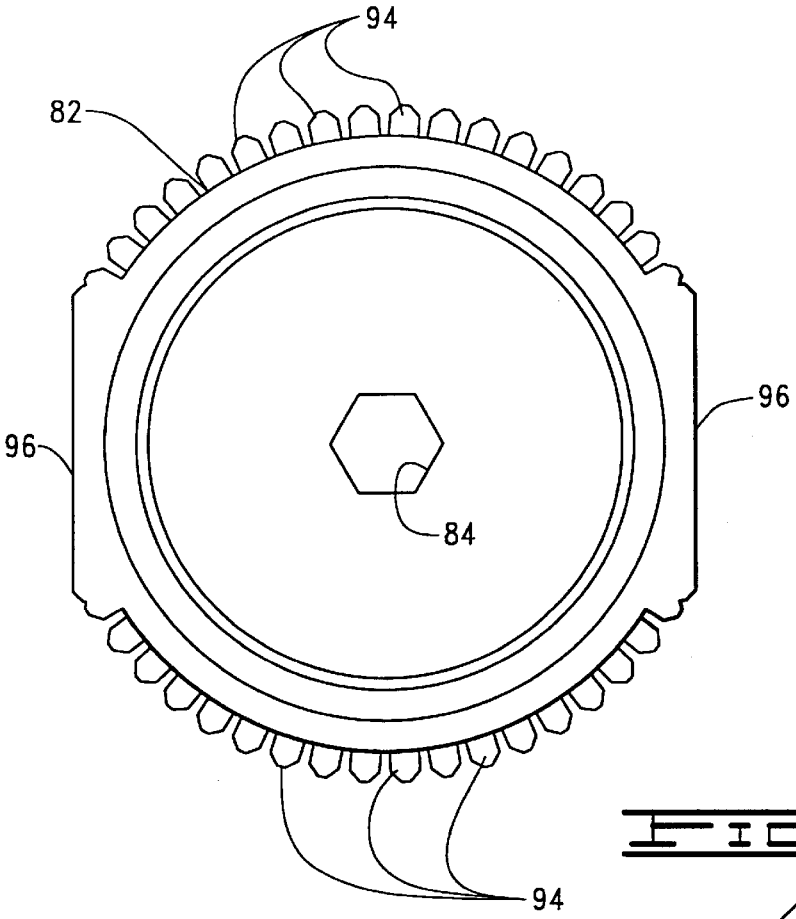
Figure 5B:
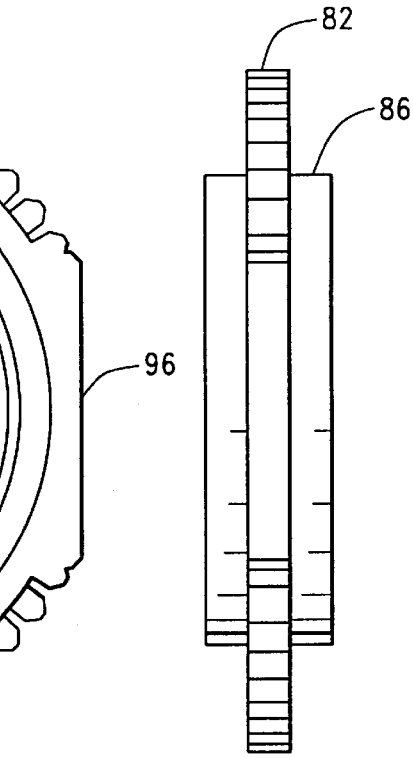
Figure 5C:
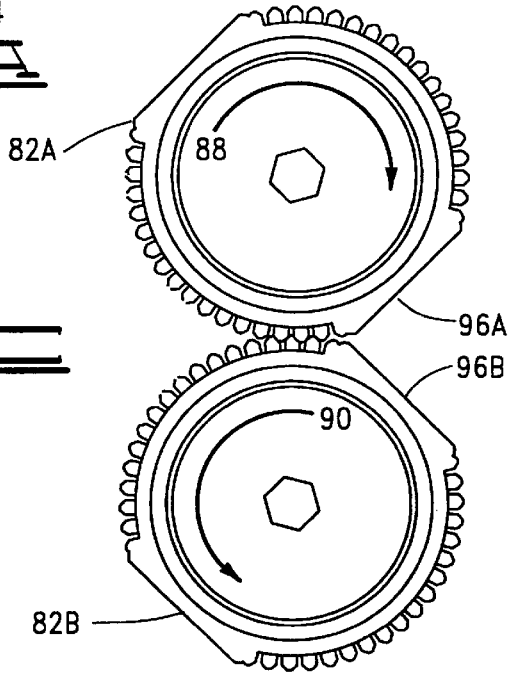

Finally, one skilled in the art will recognize the advantages of the novel characteristic shape of the louver cross-section, as shown in FIG. 5B. The louver 28 has a leasing edge 114 and a trailing edge 116, in reference to the combustion air stream passing through the air damper, shown by arrow 118. The louver has arcuate surfaces 120, 122 which are formed substantially symmetrical about a central axis 124, so as to provide a uniform air flow on both sides of the louver and thus balancing the pressure on the louver. This characteristic shape, in conjunction with the arcuate portions formed by each of the tips 106, prevents louver imbalance and uneven loading, and minimizes the noise level of the air flow across the louvers. The characteristic shape and narrow thickness of the louver 28 also provide a minimal flow restriction to the combustion air when the air damper 12 is in determinative positions near fully open.

It is clear that the present invention is well adapted to carry out the objects and to attain the ends and advantages mentioned as well as those inherent therein. While a presently preferred embodiment of the invention has been described for purposes of the disclosure, it will be understood that numerous changes may be made which will readily suggest themselves to those skilled in the art and which are encompassed within the spirit of the invention disclosed and as defined in the appended claims.

What is claimed is:

1. In a forced air combustion burner, having a fuel delivery assembly responsive to a control system which enables a modulation of heat firing rate at desired rates between a maximum rate and a minimum rate, the improvement comprising an air damper responsive to the control system for precise control of a combustion air flow rate at all firing rates, the air damper providing improved operating efficiency and turn down ratio of the burner wherein the air damper comprises:

a frame forming a rectangular frame opening through which the combustion air is passable;

a shaft rotatably supported by said frame, the shaft comprising a first end rotatable in response to the control system and thereby rotatable to determinative air flow rate positions;

a louver supported by said shaft providing a transverse profile substantially filling said frame opening in a closed position, said louver rotatable with said shaft to said determinative air flow rate positions to substantially fill the width of said frame opening and variably restrict the height of said frame opening; and means for sealing said louver within said frame to prevent air flow in the closed position, and to prevent air flow between said frame and ends of said louver, in determinative positions of minimal air flow approaching the closed position.

2. The burner of claim 1, wherein the louver comprises:

an arcuate top surface;

an arcuate bottom surface symmetrically disposed to said top surface about a central axis;

a first engaging portion, in coplanar relationship to the central axis, supporting a first tip in abutting engagement with said top surface and said bottom surface, and coextensive with the width of said louver, said first tip forming a leading edge of said louver;

a second engaging portion, in coplanar relationship to the central axis, supporting a second tip in abutting engagement with said top surface and said bottom surface, and coextensive with the width of said louver, said second tip forming a trailing edge of said louver.

3. The burner of claim 2 wherein each of said tips comprises an elastomeric material.

4. The burner of claim 3 wherein each of said tips forms a contacting face, and wherein said contacting faces sealingly engage said frame in a closed position so as to prevent air flow through said air damper.

5. The burner of claim 4 wherein each of said tips comprise a hollow passage which forms a thin material wall thickness at each of said contacting faces, so as to provide flexibility to said contacting faces to improve the sealing engagement of said contacting faces against said frame.

6. The burner of claim 5 wherein each of said tips comprises a rubber material.

7. The burner of claim 6 wherein each of said tips comprises EPDM rubber.

8. The burner of claim 1 wherein a first louver end seal is compressingly disposed between the first end of said louver and said frame, and a second louver end seal is compressingly disposed between the second end of said louver and said frame, so as to prevent air flow between the ends of said louver and said frame in a closed position, and to prevent air flow between the ends of said louver and said frame in determinative positions of minimal air flow approaching a closed position.

9. The burner of claim 8 wherein said louver and seal comprises:

a compressible foam material adhered to said frame; and a facing material substantially wider than said foam, wherein said facing material overlays said foam by adhering to said frame and by medially adhering to said foam.

10. The burner of claim 9 wherein said foam comprises polyurethane, and wherein said facing comprises a polyethylene terephthalate such as MYLAR.

11. In a forced air combustion burner assembly, having a fuel delivery assembly responsive to a control system which enables a modulation of heat firing rate at desired rates between a maximum rate and a minimum rate, the improvement comprising an air damper furthermore responsive to the control system for precise control of a combustion air flow rate at all heat firing rates, the air damper providing improved operating efficiency and turn down ratio of the burner, wherein the air damper comprises:

a frame forming a rectangular frame opening through which the combustion air passes;

a first shaft rotatably supported by said frame, the shaft having a first end rotatable in response to the control system and thereby rotatable to determinative airflow rate positions;

a second shaft rotatably supported by said frame;

means for engaging said first and second shaft as to rotate said second shaft to determinative position of said first shaft;

a first louver supported by said first shaft, said first louver rotatable with said first shaft as to be rotatable to said determinative air flow rate positions, to substantially fill the width of said frame opening and variably restrict the height of said frame opening;

a second louver supported by said second shaft, said second louver rotatable with said second shaft so as to be rotatable to said determinative air flow rate positions, to substantially fill the width of said frame opening and variably restrict the height of said frame opening; and means for sealing said louvers within said frame to prevent air flow in a closed position, and to prevent air flow between said frame and ends of said louvers in determinative positions of minimal air flow approaching a closed position.

12. The burner of claim 11, wherein each of said louvers comprises:

an arcuate top surface;

an arcuate bottom surface symmetrically disposed to said top surface about a central axis;

a first engaging portion, in coplanar relationship to the central axis, supporting a first tip in abutting engagement with said top surface and said bottom surface, and coextensive with the width of said louver, said first tip forming a leading edge of said louver;

a second engaging portion, in coplanar relationship to the central axis, supporting a second tip in abutting engagement with said top surface and said bottom surface, and coextensive with the width of said louver, said second tip forming a trailing edge of said louver.

13. The burner of claim 12 wherein each of said tips comprises an elastomeric material.

14. The burner of claim 13 wherein each of said tips forms a contacting face, and wherein said contacting faces of said louver leading edges sealingly engage said frame, and wherein said contacting face of said first louver trailing edge sealingly engages said contacting face of said second louver trailing edge so as to prevent air flow through said air damper.

15. The burner of claim 14 wherein each of said tips comprises a hollow passage which forms a thin material wall thickness at each of said contacting faces, so as to provide flexibility to said contacting faces to improve the sealing engagement of said contacting faces.

16. The burner of claim 15 wherein each of said tips comprises a rubber material.

17. The burner of claim 16 wherein each of said tips comprises EPDM rubber.

18. The burner of claim 17 wherein a first louver end seal is compressingly disposed between the first ends of said louvers and said frame, and a second louver end seal is compressingly disposed between the second ends of said louvers and said frame, so as to prevent air flow between the ends of said louvers and said frame in a closed position, and to prevent air flow between the ends of said louvers and said frame in determinative positions of minimal air flow approaching the closed position.

19. The burner of claim 18 wherein said louver end seal comprises:

a compressible foam material adhered to said frame; and a facing material substantially wider than said foam, wherein said facing material overlays said foam by adhering to said frame and by medially adhering to said foam.

20. The burner of claim 19 wherein said foam comprises polyurethane, and wherein said facing comprises a polyethylene terephthalate such as MYLAR.

21. The burner of claim 11 wherein said engaging means comprises:

a first gear supported by the distal end of said first shaft and thereby matingly engaged so that rotation of said first shaft imparts rotation to said first gear;

a second gear supported by the distal end of said second shaft and thereby matingly engaged so that rotation of said second gear imparts rotation to said second shaft; and wherein said first gear and said second gear are meshingly engaged, so that rotation of said first gear imparts an opposite rotation to said second gear, and so that rotation of said first shaft imparts an opposite rotation to said second shaft.

22. The burner of claim 21 wherein said gears comprise arc portions forming gear teeth, wherein said gear teeth of said first gear are interlocked with said gear teeth of said second gear providing said meshing engagement therebetween, and wherein said arc portions of gear teeth is less than the total circumference of said gear so that non-teeth portions are formed, so that each of said gear rotation is positively limited by rotation of the gears such that the interlocked engagement of said gears abut said non-teeth portions.

* * * * *